US005921551A

United States Patent [19]

Dunipace

[11] Patent Number: 5,921,551

[45] Date of Patent: Jul. 13, 1999

[54] DISC GOLF TARGET

[75] Inventor: David B. Dunipace, Fontana, Calif.

[73] Assignee: Champion Discs, Inc. DBA Innova Champion Discs, Inc., Rancho Cucamonga, Calif.

[21] Appl. No.: 09/058,500

[22] Filed: Apr. 10, 1998

Related U.S. Application Data

[51] Int. Cl.[6] ..... A63B 67/06

[52] U.S. Cl. ..... 273/400

[58] Field of Search ..... 273/400; 473/476

[56] References Cited

U.S. PATENT DOCUMENTS

| | | | |
|---|---|---|---|
| 4,039,189 | 8/1977 | Headrick | 273/400 |
| 4,461,484 | 7/1984 | Headrick | 273/400 |
| 4,792,143 | 12/1988 | Headrick | 273/400 |
| 5,048,845 | 9/1991 | Dunipace | 273/400 |
| 5,358,255 | 10/1994 | Jolson | 273/400 |
| 5,452,903 | 9/1995 | Larabee | 273/400 |
| 5,868,395 | 2/1999 | Headrick | 273/400 |

OTHER PUBLICATIONS

Specification entitled: "Flying Disc Entrapment Device", Serial No. 678,125 (Filed: Apr. 19, 1976). From File History of Patent No. 4039189 (Aug. 2, 1977) Inventors: Edward E. Headrick and Kenneth A. Headrick.

2 Internet pages illustrating INNOVA–Champion Discs and the INNOVA DISCatcher® Pro Model Disc Golf Target from WEB SITE: http://www.innovadiscs.com/innova.design.cost.html, printed Sep. 27, 1996.

1 Internet page illustrating the Mach V from WEB SITE: http:/www.discgolfassoc.com/machfam.html, printed Mar. 10, 1998.

4 Internet pages illustrating STROKE SAVER Disc Golf Targets from WEB SITE: http://www.angelfire.com/tx/strokesaver (about 1997).

Advertisement (one page) illustrating the Audio Visual Disc Target (about 1997).

Advertisement (one page) illustrating the FSN Bird Cage (about 1997).

*Primary Examiner*—William H. Grieb
*Attorney, Agent, or Firm*—Lyon & Lyon LLP

[57] ABSTRACT

A disc golf target includes a center post, a chain rack supported by the post, and a lower basket supported by the post opposite the chain rack. The chain rack has a hub mounted to the post, a plurality of spokes radially extending from the hub for supporting the circumference of the chain rack in concentric alignment with the hub, and a plurality of attachment points concentrically disposed between the hub and the circumference of the chain rack. A plurality of outer chains having first and second ends has the first end supported by the chain rack and the second end attached to an outer chain ring disposed about the post near the basket. A plurality of inner chains having first and second ends has each end supported by a respective attachment point wherein the inner chains vertically hand downward from the attachment points in an overlapping fashion to define an inner envelope for catching a disc.

19 Claims, 2 Drawing Sheets

DISC GOLF TARGET

BACKGROUND OF THE INVENTION

The field of the present invention generally relates to flying disc entrapment devices such as for use in the sport of disc golf. In playing the game, a flying disc is thrown toward a "hole" which in disc golf comprises an entrapment device. A typical entrapment device includes a center pole, a lower basket, and a plurality of loosely hanging chains disposed above the basket. The chains are functionally arranged to effectively catch a disc by absorbing its kinetic energy and dropping the disc into the basket.

The sport has enjoyed increasing popularity in recent years with improvements in discs and entrapment devices. Players choose from a multitude of discs varying in design, size and weight. Complex disc entrapment assemblies designed to absorb the kinetic energy of a thrown disc have evolved to accommodate this disc variety. Despite such improvements, entrapment devices still lack the degree of catchability desired by the avid disc golfer.

For example, with respect to the flying disc entrapment device described in U.S. Pat. No. 4,461,484, incorporated herein by reference, the present inventor has recognized that device does not always capture discs aimed at the lower end of its entrapment region. This failure is due to the tendency of some throws to bounce off the lower end which has dense or hard spots caused by attaching inner chains to an inner chain ring near the basket. Throws bouncing off chains tend to land clear of the basket—an unsatisfactory result. In addition, some throws striking at the lower end of the entrapment region, but discs aimed at the upper end of the entrapment region, in particular to the right and left of the post, tend to split through the chains and exit the opposite side. This disadvantage is due to the overall lack of coverage of the disclosed chain arrangement and because the inner chains are precluded from moving in concert with one another for increased kinetic absorbing catchability. Thus the present inventor has recognized the desirability of a disc golf target solving the aforementioned problems to further enhance the enjoyment of the game.

SUMMARY OF THE INVENTION

The present invention is directed to a disc golf target having a center post, a chain rack mounted to the upper end of the post, and a lower basket mounted to the post opposite the chain rack. The chain rack preferably has a hub with a plurality of spokes extending radially outward therefrom for hanging outer and inner sets of chains. Each outer chain has one end supported by a hanger member disposed near an outer perimeter of the chain rack and the other end of each outer chain attached to an outer chain ring near the top of the basket. Each inner chain has both its ends attached to the chain rack, each chain being adapted to vertically hang downward from the chain rack in a draped, symmetrical arrangement wherein the inner chains define an inner envelope for catching discs.

Accordingly, it is an object of the present invention to provide a flying disc entrapment device with improved catchability. Other and further objects and advantages of the present invention will be further understood and appreciated by those skilled in the art by reference to the following specification, claims, and annexed drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
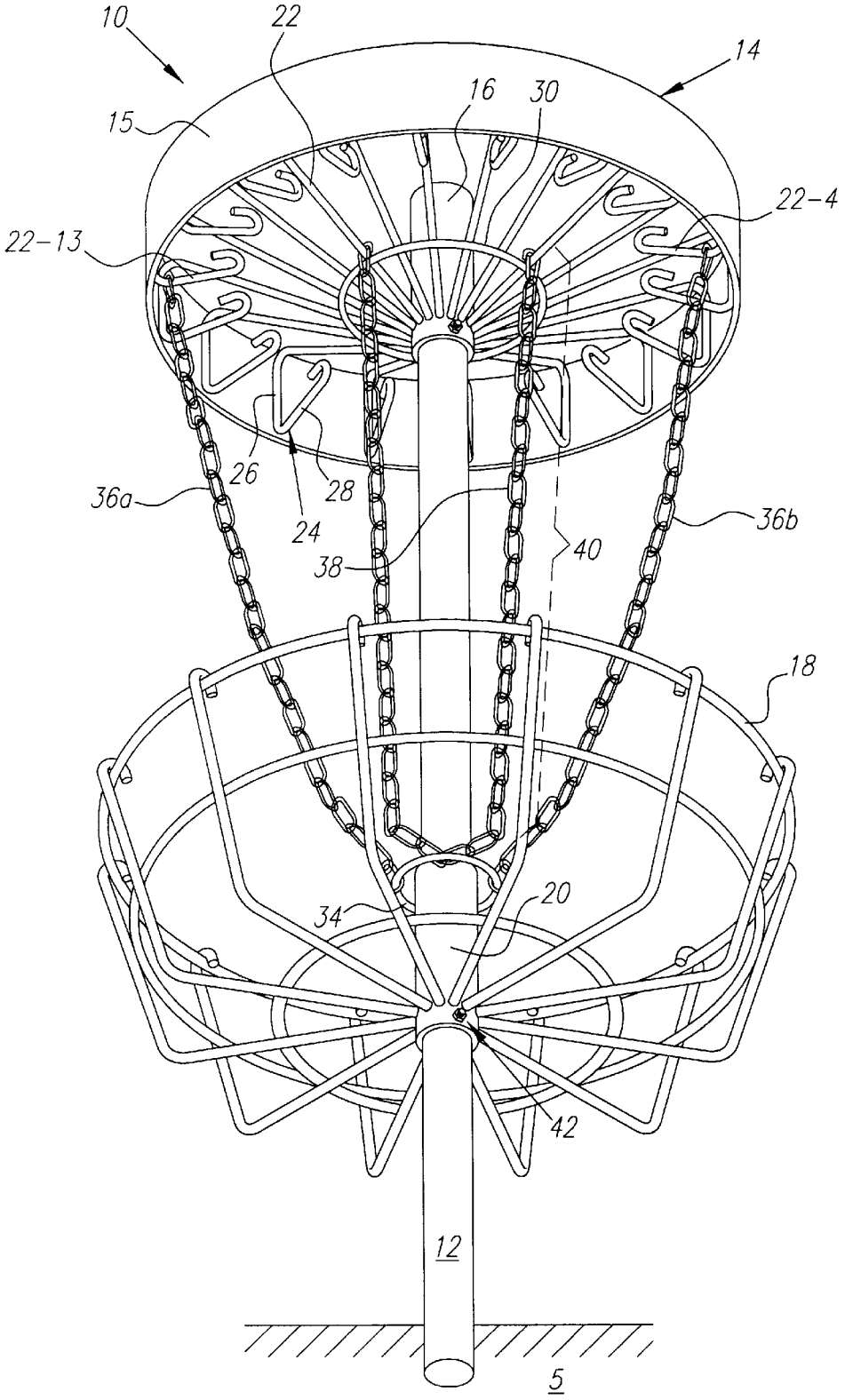
FIG. 1 is a perspective view according to a preferred embodiment of the present invention.
Figure 2:
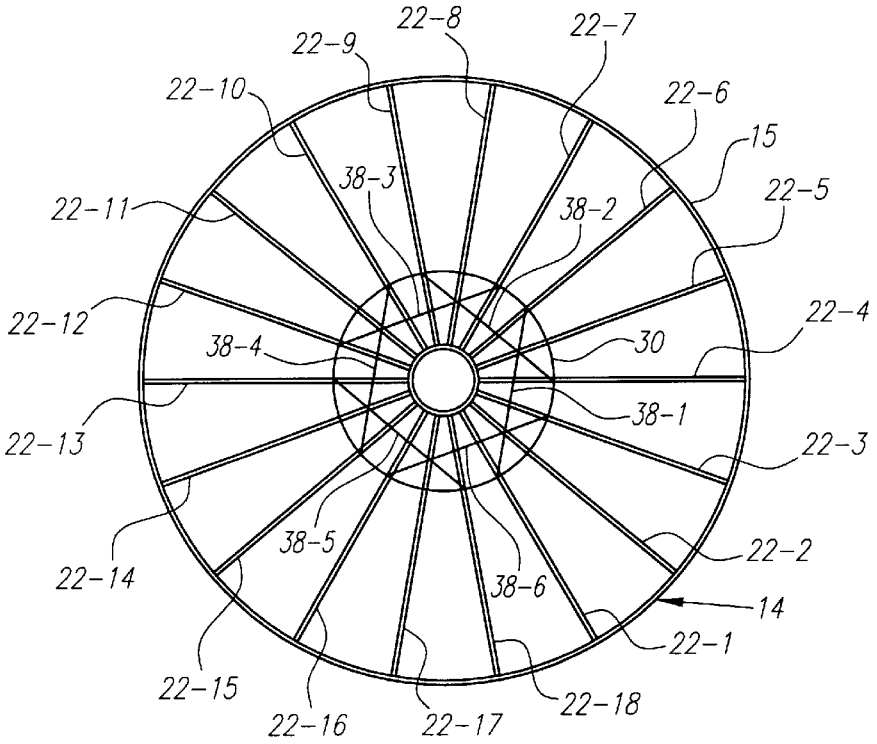
FIG. 2 is a diagrammatic top view of the chain rack and inner chains shown in FIG. 1.

The preferred embodiments will now be described with reference to the drawings. In FIGS. 1 and 2, a disc golf target 10 is shown including a center post 12, a chain rack 14 having a sleeve or hub 16 mounted to the upper end of the post 12, and a lower basket 18 having a hub or sleeve 20 mounted to the post 12 opposite the chain rack 14. The bottom end of the post is either mounted in the ground 5 or to a stand (not shown). The chain rack includes the hub 16, a plurality of spokes 22 and a wide outer band 15 at an outer circumference of the spokes 22. Each of the spokes 22 (preferably eighteen, numbered as 22-1 through 22-18 in FIG. 2) are mounted with one end attached to the chain rack hub 16 and extending radially outwardly from the chain rack hub 16 and slightly upwardly toward the top of the band 15 of the chain rack 14. Each of the spokes 22 has, at its outer end, a bent hanger portion 24 with a first hanger member 26 attached (such as by welding) to an inner circumferential surface of the band 15 and a second hanger member 28 extending radially inwardly and slightly upwardly to the first hanger member 26. The spokes 22 are preferably equidistantly spaced from one another.

An inner chain ring 30 is attached to the spokes 22 at a position in concentric alignment with the chain rack 14. The ring 30 has a diameter approximately one-third that of the chain rack 14. An outer chain ring 34 is disposed near the sleeve 20 of the basket 18 in concentric alignment with the inner chain ring 30. The outer chain ring 34 is preferably supported below the level of the top of the basket 18. A plurality of outer chains 36, preferably eighteen, each has an upper end supported by a hanger 24 with the lower end attached to the outer chain ring 34 such that the chains 36 hang loosely with their lower ends gathered together by ring 34. Only two such outer chains 36*a,* 36*b* of the eighteen chains are shown in FIG. 1 for purposes of clarity. In similar fashion as illustrated by chains 36*a,* 36*b,* an outer chain is suspended from each spoke 22-1 through 22-18 and attached to ring 34.

A set of inner chains 38, preferably numbering six or nine, each has one end supported by a spoke 22 near the outer circumference of the inner chain ring 30 with the other end supported by another spoke 22 near the outer circumference of the inner chain ring 30. Only one such inner chain 38 is shown in FIG. 1. The inner chains 38 vertically hang downward from the chain rack 14 from their respective attachment points in an overlapping and draped fashion. In particular, each inner chain 38 is symmetrically arranged to drape over at least one other inner chain 38 as shown in FIGS. 2 and 3.

FIG. 2 diagrammatically shows, on an enlarged scale, a preferred six inner-chain/eighteen outer-chain embodiment where the symmetrical arrangement is as follows: inner chain 38-1 is supported by spokes 22-1 and 22-6; chain 38-2 is supported by spokes 22-4 and 22-9; chain 38-3 is supported by spokes 22-7 and 22-12; chain 38-4 is supported by spokes 22-10 and 22-15; chain 38-5 is supported by spokes 22-13 and 22-18; and chain 38-6 is supported by spokes 22-16 and 22-3. To these ends, each inner chain 38 has been symmetrically arranged to vertically drape over two other inner chains 38.

Figure 3:
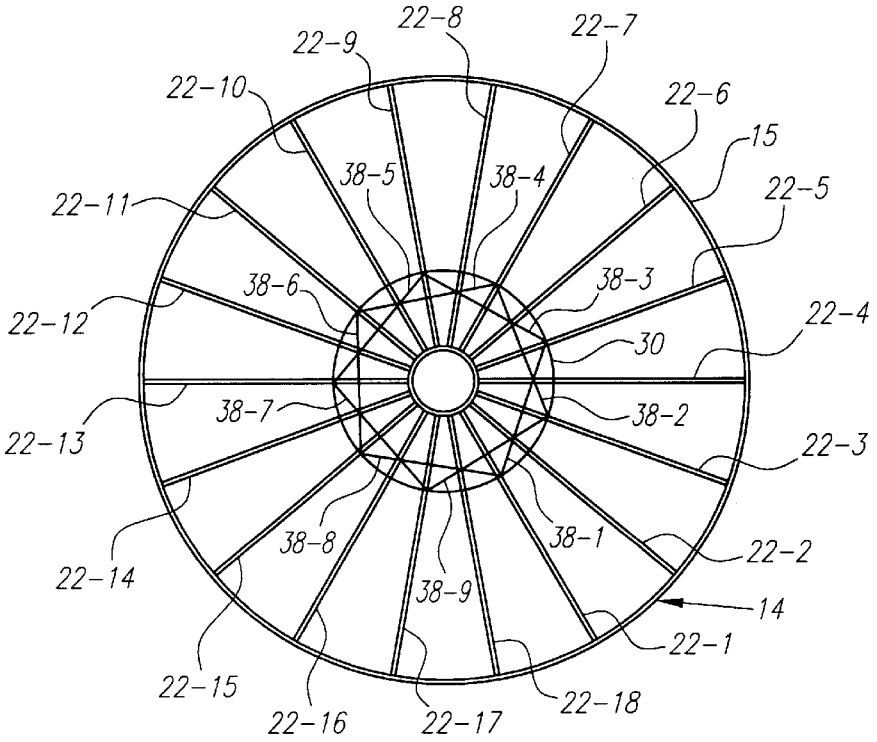
FIG. 3 is a diagrammatic top view of the chain rack and inner chains according to another embodiment of the present invention.

FIG. 3 diagrammatically shows, on an enlarged scale, the nine inner-chain/eighteen outer-chain embodiment where the symmetrical arrangement is as follows: inner chain 38-1 is supported by spokes 22-1 and 22-5; chain 38-2 is supported by spokes 22-3 and 22-7; chain 38-3 is supported by spokes 22-5 and 22-9; chain 38-4 is supported by spokes 22-7 and 22-11; chain 38-5 is supported by spokes 22-9 and 22-13; chain 38-6 is supported by spokes 22-11 and 22-15; chain 38-7 is supported by spokes 22-13 and 22-17; chain 38-8 is supported by spokes 22-15 and 22-1; and chain 38-9 is supported by spokes 22-17 and 22-3. The symmetrical arrangement of the nine chain embodiment is similar to the symmetrical arrangement of the six chain embodiment in that each inner chain 38 vertically drapes over two other inner chains 38.

While the six inner-chain/eighteen outer-chain embodiment can be described as having one end of a inner chain 38 supported by a first spoke 22 and the other end of the inner chain 38 supported by a second spoke 22 five spokes 22 away from the first spoke 22, the preferred nine inner-chain/eighteen outer-chain embodiment has one end of a chain 38 supported by a first spoke 22 and the other end of the chain 38 supported by a second spoke 22 four spokes 22 away from the first spoke 22.

Advantageously, with the inner chains 38 adapted to vertically hang downward from the chain rack 14 in either one of the preferred arrangements, a net or inner envelope (shown by the dashed lines 40 in FIG. 1) is symmetrically defined for effectively catching a disc thrown at all regions of the envelope 40. In particular, these configurations advantageously eliminate dense or hard spots while increasing momentum stopping capability. Not only is the hard spot that is created by attaching inner chains to an inner chain ring near the basket eliminated, but the hard spot that is created by the inner chain ring itself is eliminated. Furthermore, having the inner chains 38 draped across one another provides more coverage in the envelope 40 than merely attaching an inner chain to an inner chain ring or leaving the bottoms of the inner chains untethered.

The chain configurations of the preferred embodiments advantageously permit the inner chains 38 to move in concert with one another. On the sides of the envelope 40, because they are draped, the inner chains 38 act in concert with one another for enhanced momentum stopping capability. A disc striking the envelope 40 may cause two or more inner chains 38 to work together to more effectively absorb the kinetic energy of the disc than a chain attached to an inner chain ring or any number of untethered chains.

Other inner draping chain configurations and numbers of chains may be employed, but it is preferred that the draping be symmetrical, and that each inner chain overlap with at least one other inner chain.

Inner draping chain configurations may also be employed with alternate outer chain configurations, such as straight hanging outer chains, but the outer chain configuration of FIG. 1 with the lower ends gathered together by the ring 34 is preferred.

The disc golf target 10 may be permanent or portable. FIG. 1 shows a permanent arrangement. In construction of the device 10 shown in FIG. 1, the post 12 is a standard 1½ inch hot-dipped galvanized steel pipe having a 1⅞ inch outer diameter cut to a length of 74 inches. Approximately 18 inches of the bottom end of the post 12 is mounted into the ground 5. The chain rack 14 and the basket 18 are preferably made from steel using welded steel construction techniques with a bright yellow, powder-coated finish over the steel. In the alternative, the chain rack 14 and the basket 18 may be made from electro-galvanized steel without a powder-coated finish. The outer band 14 of the chain rack 14 is a plate rolled into a cylindrical shape having a 22 inch outer diameter and 4 inch high side. The inner chain ring 30 is preferably 8 inches in outer diameter which is about one-third the diameter of the chain rack 14. The ring 30 is attached to the spokes 22 by spot welding. This diameter has been found to create an envelope 40 which provides the best catchability. The spokes 22 preferably extend radially from the 4 inch high chain rack hub 16 approximately 1 inch from the bottom. In this manner, the spokes 22 extend upwardly toward the top of the outer band 15 of the chain rack 14 advantageously using gravity to keep the inner chains 38 resting against the outer circumference of the inner chain ring 30 in order to hang vertically downward from the chain rack 14.

The lower basket 18 is 10 inches high with a 26 inch outer diameter at the top and a 24 inch outer diameter at the bottom. The basket 18 is an upwardly open basket.

The outer chain ring 34 is 4 inches in outer diameter gathering the lower ends of the outer chains 38 together near the post 12 and generally near or in the basket 18. The basket sleeve 20 is slipped on the post 12 and the basket 18 is mounted to the post intermediately between the upper and lower ends of the post 12 via a bolt and nut arrangement 42. Other commonly known means of mounting may also be employed such as a threaded post and matingly receivable sleeve arrangement. Such an arrangement is preferred when the disc golf target 10 is constructed to be portable for ease of shipment. The outer chain ring 34 is then slipped over the post 16 and disposed near the top of the basket 18. The chain rack hub 16 is then slipped on the upper end of the post 12 and the chain rack 14 is mounted thereto in the same manner as the basket 18. The post 12 may be threaded at its bottom end and then screwed into a 24 inch pedestal base (not shown), adding 2 inches in height. The inner chains 38 are then vertically hung from the spokes 22 near the inner chain ring 30 in one of the above-identified preferred symmetrical arrangements. Each outer chain 36 is then hung on a respective hanger 24 and attached to the outer chain ring 34. Hot dipped galvanized 2-ought straight link coils are preferred for both the outer and inner chains 36, 38. Advantageously, this embodiment allows for pre-existing disc golf targets to be easily retrofitted with inner chains without requiring disassembly of the target. A user may purchase the preferred number of inner chains 38 off the shelf, and using a pair of pliers in conjunction with a diagram of FIG. 1 or 2 showing the respective preferred symmetrical arrangement, retrofit a pre-existing golf target by crimping inner chains 38 on the spokes 22 where shown by the diagrams. Alternately, the chains 38 may be attached to the ring 30 or to separate attachment hooks on either the spokes 22 or the ring 30.

In operation, the disc golfer throws a disc toward the disc golf target 10. After striking the outer chains 36, the disc enters the inner envelope 40 defined by the inner chains 38. Due to the vertically hanging and overlapping arrangement of the inner chains 38, a disc thrown at all regions of the envelope 40 should advantageously be caught by a plurality of inner chains 38, causing the disc to fall into the basket 18.

Thus, a disc golf target with improved catchability has been disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A disc entrapment device comprising:

a center post having a lower end and an upper end;

a chain rack having a centrally disposed hub and a plurality of spokes radially extending from the hub to the circumference of the chain rack, the hub being mounted to the upper end of the post;

a basket having a sleeve mounted to the post intermediate the lower and upper ends;

a plurality of outer chains having first and second ends, the first end supported by the chain rack and the second end extending into the basket;

a plurality of inner chains having first and second ends, each end supported by the chain rack wherein the inner chains vertically hang downward from the chain rack to define an inner envelope for catching a disc.

2. The disc entrapment device according to claim 1, wherein the plurality of inner chains are symmetrically arranged to drape in an overlapping fashion.

3. The disc entrapment device according to claim 1, wherein the plurality of inner chains are supported by the chain rack at attachment points concentrically disposed between the hub and the circumference of the chain rack.

4. The disc entrapment device according to claim 1, further comprising an inner chain ring concentrically disposed on the spokes between the hub and the circumference of the chain rack.

5. The disc entrapment device according to claim 4, wherein the spokes are equidistantly spaced from one another and each end of each inner chain is supported by a respective spoke near the inner chain ring.

6. The disc entrapment device according to claim 4, wherein the inner chain ring is about eight inches in diameter.

7. The disc entrapment device according to claim 1, wherein six inside chains are overlappingly supported by the spokes.

8. The disc entrapment device according to claim 1, wherein nine inside chains are overlappingly supported by the spokes.

9. A flying disc entrapment assembly comprising:

a post having an upper end and an opposing lower end;

a hub mounted to the upper end of the post;

an outer chain rack ring concentrically disposed about the hub;

a plurality of spokes radially extending from the hub for supporting the outer chain rack ring;

a plurality of attachment points concentrically disposed between the hub and the outer chain rack ring;

an upwardly open basket mounted to the post intermediately between the hub and the lower end of the post;

an outer chain ring disposed about the post near the basket;

a plurality of outside chains, each outside chain having a first end and a second end, the first end supported by the outer chain rack ring and the second end attached to the outer chain ring wherein the outside chains extend into the basket; and a plurality of inside chains, each inside chain having a first end and a second end, each end attached to a respective attachment point wherein the inner chains vertically hang downward from the attachment points, the inside chains defining an inside envelope for catching a disc.

10. The disc entrapment assembly according to claim 9, wherein the plurality of inner chains are symmetrically arranged and wherein each inner chain drapes over at least one other inner chain in an overlapping fashion.

11. The disc entrapment assembly according to claim 9, further comprising an inner chain ring concentrically disposed between the hub and the outer chain rack ring.

12. The disc golf entrapment assembly according to claim 11, wherein six inside chains are overlappingly supported by the spokes.

13. The disc golf entrapment assembly according to claim 11, wherein nine inside chains are overlappingly supported by the spokes.

14. The disc golf entrapment assembly according to claim 12, wherein the spokes are equidistantly spaced from one another, the first end of each of the six inside chains attached to a first spoke near the inner chain ring and the second end of each of the six inside chains attached to a second spoke five spokes away from the first spoke.

15. The disc golf entrapment assembly according to claim 13, wherein the spokes are equidistantly spaced from one another, the first end of each of the nine inside chains attached to a first spoke near the inner chain ring and the second end of each of the nine inside chains attached to a second spoke four spokes away from the first spoke.

16. The disc golf entrapment assembly according to claim 9, wherein each of the spokes has a hanger disposed on the outer chain rack ring for respectively supporting the first end of each of the outside chains.

17. The disc golf entrapment assembly according to claim 16, wherein the spokes are inclined upwardly toward the outer chain rack ring.

18. The disc golf entrapment assembly according to claim 11, wherein the inner chain ring has a diameter of about eight inches.

19. A method of capturing a disc thrown at a disc golf target having a post, a chain rack having a hub mounted to the post, a plurality of spokes radially extending from the hub for supporting the circumference of the chain rack in concentric alignment with the hub, and a plurality of attachment points concentrically disposed between the hub and the circumference of the chain rack, the method comprising the steps of:

hanging one end of a first chain from a first attachment point;

hanging the other end of the first chain from a second attachment point;

hanging one end of a second chain from a third attachment point; and hanging the other end of the second chain from a fourth attachment point, wherein the first chain and the second chain vertically drape downward from the chain rack in a symmetrical, overlapping manner to define an inner envelope for catching a disc.

* * * * *